United States Patent [19]

Honecker et al.

[11] 3,970,171

[45] July 20, 1976

[54] THREE-STAGE LOAD-LIFTING ASSEMBLY FOR FORK-LIFT TRUCKS

[75] Inventors: Gunter Honecker, Klein Welzheim; Kurt Knappe, Sulzbach, both of Germany

[73] Assignee: Linde Aktiengesellschaft, Hollriegelskreuth, Germany

[22] Filed: June 26, 1975

[21] Appl. No.: 590,577

[30] Foreign Application Priority Data

June 26, 1974 Germany ..... 2430789

[52] U.S. Cl. ..... 187/9 E; 92/53; 187/95; 254/93 R

[51] Int. Cl.[2] ..... B66F 9/20

[58] Field of Search ..... 187/9 E, 17, 95, 8.41, 187/8.47, 8.49, 8.5; 214/660, 670, 671, 672, 673, 674; 52/115, 118; 212/55; 254/89 H, 93 R, 93 L, 93 H; 92/110, 113, 117 R, 117 A, 52, 53; 91/167, 168

[56] References Cited

UNITED STATES PATENTS

| | | | |
|---|---|---|---|
| 644,641 | 3/1900 | Sibley | 254/93 R X |
| 1,799,298 | 4/1931 | Jakob | 254/93 H X |
| 2,670,811 | 3/1954 | Shaffer | 187/9 E |
| 2,915,144 | 12/1959 | Olson | 187/9 E |
| 3,252,680 | 5/1966 | Lee et al. | 92/52 X |
| 3,279,563 | 10/1966 | McNeeley | 187/9 E |
| 3,344,890 | 10/1967 | Loef | 187/9 E |

*Primary Examiner*—Evon C. Blunk
*Assistant Examiner*—James L. Rowland
*Attorney, Agent, or Firm*—Karl F. Ross; Herbert Dubno

[57] ABSTRACT

A load-lifting assembly for a fork-lift truck has a mast formed of three telescoping tubes, an inner tube secured to the support, an intermediate tube slidable on the inner tube, and an outer tube slidable on the intermediate tube and carrying a carriage on which the fork is mounted. A cable or chain has one end secured to the intermediate tube and is passed over a roller on the top end of the outer tube and secured to the carriage. The three-stage ram has a first member inside the inner tube and secured to the support, a second tubular member slidable on the first member and linked to the intermediate tube, and a third member slidable on the intermediate member and secured to the outer tube. The effective piston area of the third member is greater than that of the second member so that on pressurization of the interior of the ram the third member will move up relative to the first and second members before the second member moves up.

10 Claims, 10 Drawing Figures

THREE-STAGE LOAD-LIFTING ASSEMBLY FOR FORK-LIFT TRUCKS

CROSS REFERENCE TO RELATED APPLICATIONS

This application is related to copending patent application Ser. No. 565,111 filed April 4, 1975 as a division of patent application Ser. No. 375,008 filed July 29, 1973, now U.S. Pat. No. 3,930,563.

FIELD OF THE INVENTION

The present invention relates to a fork-lift truck. More particularly this invention concerns a load-lifting assembly for such a truck.

BACKGROUND OF THE INVENTION

A fork-lift truck usually has a vehicular body constituting a support on which is typically mounted a pair of masts spaced apart transversely relative to the normal direction of travel of the body. Suspended from the masts by means of a flexible element such as a cable or chain is a carriage provided with the load-engaging fork. A hydraulic ram is provided that is extensible against a pulley over which the flexible element is passed so that on extension this ram causes the carriage hung on the flexible element to be raised.

In most such arrangements each mast is formed of a fixed channel portion and a vertically displaceable channel portion slidable by means of hydraulic pressure in the fixed portion. One of these portions is usually operated by a cylinder and the other by a piston. In order to achieve a high lift it is known to provide multiple-stage rams. All such structures, however, are relatively complicated and are both inadequately rigid when extended and excessively complex so that their use in very dirty conditions requires frequent overhaul.

OBJECTS OF THE INVENTION

It is therefore an object of the present invention to provide an improved load-lifting assembly for a fork-lift truck or the like.

Another object is the provision of such an assembly which has a high degree of rigidity when extended and which can achieve relatively high lifts.

Yet another object is to provide a load-lifting assembly which is not outwardly open so that foreign matter cannot get into the delicate hydraulic mechanism and which minimally obstructs the operator's forward view.

SUMMARY OF THE INVENTION

These objects are attained according to the present invention in a load-lifting assembly having an inner tube fixed to the support, an intermediate tube vertically telescopingly slidable on the inner tube and guided thereon, and an outer tube vertically telescopingly slidable on the intermediate tube and guided thereon. The carriage is vertically slidable along and guided on the outer tube, with a flexible elongated element such as a chain or cable connecting the outer tube to the carriage. A three-stage extensible hydraulic ram in addition to the tubes has a first member secured to the inner tube, a second member riding on the first member and secured to the intermediate tube, and a third member riding on the second member and secured to the outer tube. Thus the second member is displaceable relative to the inner tube and the outer tube. On pressurization of this three-stage ram the members are telescoped to displace the tubes and carriage from a down position with the carriage lowered and the outer tube completely surrounding the intermediate tube and the inner tube, and an up position with the carriage lifted and the tubes telescoped upwardly apart.

As a result of the size relationship of the piston surfaces in the three-stage ram the displacement order of the separate ram members follows a particular order. In this case the third ram member attached to the outer tube moves first, since the elongated element from which the carriage is hung is passed over a wheel or pulley carried on this outside tube.

In accordance with the present invention the first member carried on the inner tube is a piston, and the third member carried on the outer tube is a cylinder. The second element between this piston and cylinder is generally tubular and constitutes functionally both a piston and a cylinder, it may either surround the piston and slide within the cylinder, or surround both the piston and the cylinder. Means for actuating the assembly includes a fluid inlet passage passing through the piston constituting the first member and opening into the chamber formed by the cylinder of the third member and the second member.

According to further features of this invention each of the members is formed as a tube, all of these tubes being coaxial with each other and with the inner, outer, and intermediate tubes. The first member is a tube of the same height as the inner tube and secured to the support. The third member is another tube secured to the outer tube and having a closed upper end. The second member is also a tube which slides on the outside of the tubular first member and either on the inside or outside of the second member. Structure including at least one annular plate secured to at least one axial end of the tube constituting the second member is secured to the intermediate tube. When the second tube surrounds both the first and second tubular members only this plate need connect the upper end of the tube constituting the second member with the upper end of the intermediate tube. Where the tube constituting the second member is within the tube constituting the third member and surrounds the tube constituting the first member a plate is provided at the lower end of the second member and another tube is provided which snugly surrounds the tube constituting the third member and which is connected at its upper end via a plate to the upper end of the intermediate tube and at its lower end to the plate carried on the lower end of the second tube.

In all cases the annular chambers formed between the first member and the inside tube, the second member and the intermediate tube, and the third member and the outside tube are vented to the atmosphere.

According to another feature of this invention the flexible element on which the carriage is hung, typically a chain or cable, has one end secured to the carriage, and another end secured to the top of the intermediate tube. This carriage slides up and down on the outside of the outer tube which itself carries a deflecting element such as a roller over which the cable or chain passes. Thus in the initial stages of lifting the outer tube only will lift relative to the intermediate and inner tube, causing the carriage to rise at twice the displacement speed of this outer tube. Once the outer tube reaches the top of its limit of travel relative to the intermediate tube this latter tube then rises relative to the inner tube, with the carriage remaining at the upper portion of the outer tube. This particular sequence is, as mentioned above, adhered to because the effective piston surface area of the upper or third member is considerably greater than the effective piston area of the second or intermediate member of the three-stage ram. If this relationship is not adhered to the intermediate and outer tubes would first rise on the inner tube, and only thereafter would they separate and the outer tube rise on the intermediate tube.

Such an arrangement has a pair of masts formed as load-lifting assemblies as described above. These masts are spaced apart transverse to the normal displacement direction of the support and a single flexible element may be provided between the masts with one end secured to the carriage, another end secured to a beam passing between the tops of the intermediate tubes, and passing over a pulley carried on a beam between the two outer tubes.

The arrangement according to the present invention can be produced at relatively low cost and can be made extremely compact so as to aid in driver visibility when mounted on a lift truck. In the arrangement wherein the second tubular member surrounds both the first tubular piston member and the third tubular piston member it is possible to produce a system having a very small diameter. In addition it is advantageous in this arrangement to mount the carriage-suspending chain such that it is drawn into the outer tube on lifting thereof.

According to further features of this invention a central oil vent can be provided in the arrangement to lead off any oil leaking out of the ram into the spaces between the ram and the tubes. Removable covers on the top and bottom of the arrangement simplify service and greatly aid in assembly of the system in accordance with the present invention.

BRIEF DESCRIPTION OF THE DRAWING

The above and other objects, features, and advantages will become more readily apparent from the following, reference being made to the accompanying drawing in which.

SPECIFIC DESCRIPTION

Figure 10:
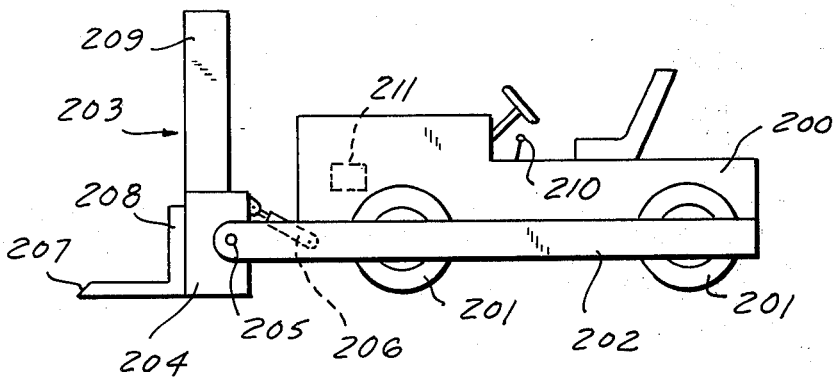
FIG. 10 is a side view of a lift truck equipped with the apparatus according to the present invention.

Referring first to FIG. 10 a fork-lift truck according to the invention comprises a vehicle body 200 having wheels 201 and a chassis 202. The mast assembly 203, as shown in detail in FIGS. 1–9, comprises a lower frame portion 204 pivoted at 205 to the chassis and swingable about the pivot 205 by a hydraulic tilting cylinder arrangement 206. A fork 207 is mounted on a carriage 208 slidable upon the upper mast section 209 here shown to be telescoped over the columns of the lower mast section. Only one mast 203 is visible in FIG. 10, but two such assemblies are provided side-by-side. Means is provided, controlled by a lever 210 and including a pump 211 for raising the fork 207 and its carriage 208 for lifting this section relative to the tiltable frame on the support 204.

FIGS. 1 through 6 show an arrangement having a lower transverse support beam 12 corresponding to the support 204 of FIG. 10. An intermediate mast tube 10 rides on a lower or inner mast tube 11 secured fixedly to the support 12. The upper end of the tube 11 is provided externally with a guide 13 and lower end of the intermediate tube 10 is provided internally with a similar such guide 14, so that these two elements slide easily on one another. In addition these guides 13 and 14, in the form of self-lubricating PTFE rings, are inset into the respective tubes 11 and 10 so as to act as stops limiting the maximum vertical displacement of the tube 10 relative to the tube 11. Further such guide rings 15 and 16 are provided outside the upper end of the tube 10 and inside the lower end of the upper or outer tube 9 so as to guide the latter on the former and act as end stops.

A tubular piston 17 is mounted on and extends vertically up from the support 12. This piston 17 has a vertically throughgoing passage 18 for pressurization of the chambers $C_1$ and $C_2$ formed above it and is provided with a gasket 19 so as to seal it within an intermediate tube 88 of a three-part ram the lower part of which is constituted by the piston 17 and the uppermost part of which is constituted by a further tube 93. This tube 93 has a closed upper end and is provided with a seal 94 snugly engaging the outside of the intermediate tube 88, which in turn has a seal 89 snugly engaging the outside of the pistons 17.

An annular plate 90 secured to the lower end of the intermediate ram tube 88 is secured to the lower end of an attachment tube 91 that is connected at its upper end via an annular plate 92 to the top end of the tube 10. Thus the coaxial tubes 10, 91, and 88 are all rigidly interconnected to move vertically together.

Figures 1, 2, 3:
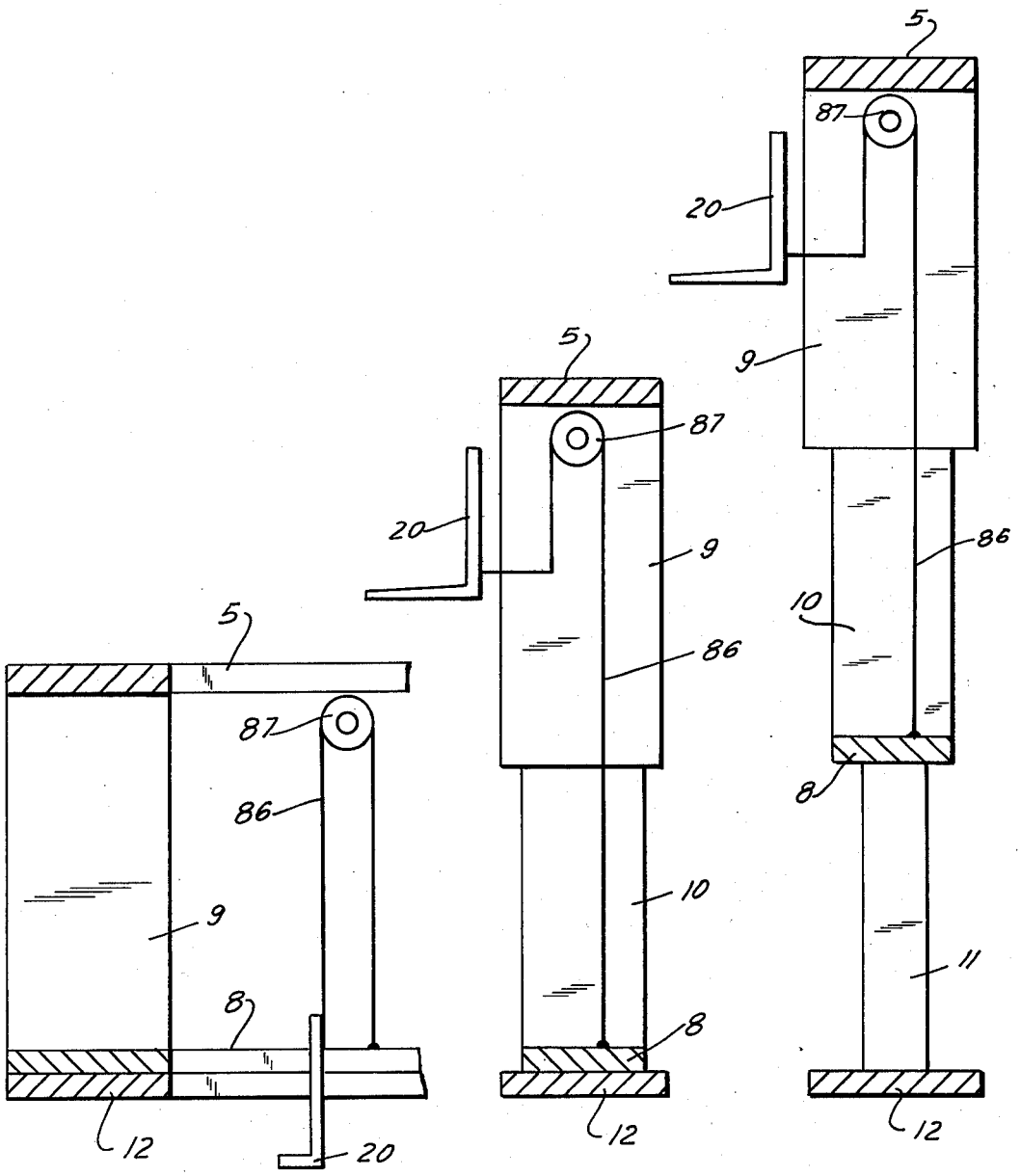
FIG. 1 is a front partly sectional view of an arrangement according to the present invention, shown here in the down position.
FIG. 2 is a side view showing the assembly of FIG. 1 partly raised.
FIG. 3 is a side view similar to FIG. 2 illustrating the assembly fully raised.
Figure 4:
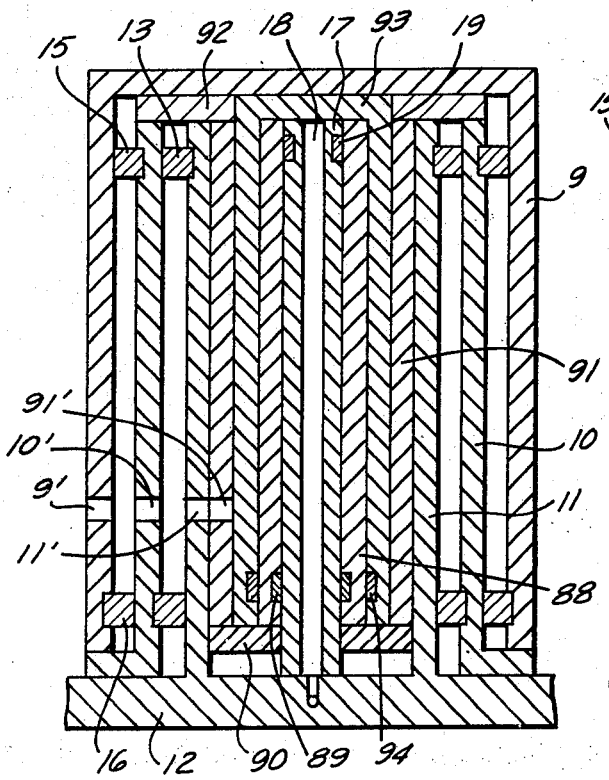
FIGS. 4, 5, and 6, are vertical sections taken through a lifting device in the positions shown in FIGS. 1, 2, and 3, respectively.

Relative to the central axis A on which all of the above-mentioned tubes are centered, the upper tube 93 of the three-part ram 17, 88, 93 has an internal radius $r_1$ substantially greater than the inside radius $r_2$ of the tube 88, which is identical to the outside radius of the piston 17. The effective surface area of the tubular ram member 93 is proportional to this radius $r_1$ and the effective surface area of the ram member 88 is proportional to the difference between the radius $r_1$ and $r_2$. As best shown in FIGS. 1–3, the fork 20 is hung on an end of a cable 86 spanned over a pulley 87 supported on an upper traverse 5 extending between two of the outer tubes 9 and has another end connected to a traverse 8 extending between the tubes 10. The effective surface area of the tube 93 is considerably greater than the effective surface area of the tube 88 so that this tube 93 will rise first on pressurization of the chamber through the passage 18.

Figure 5:
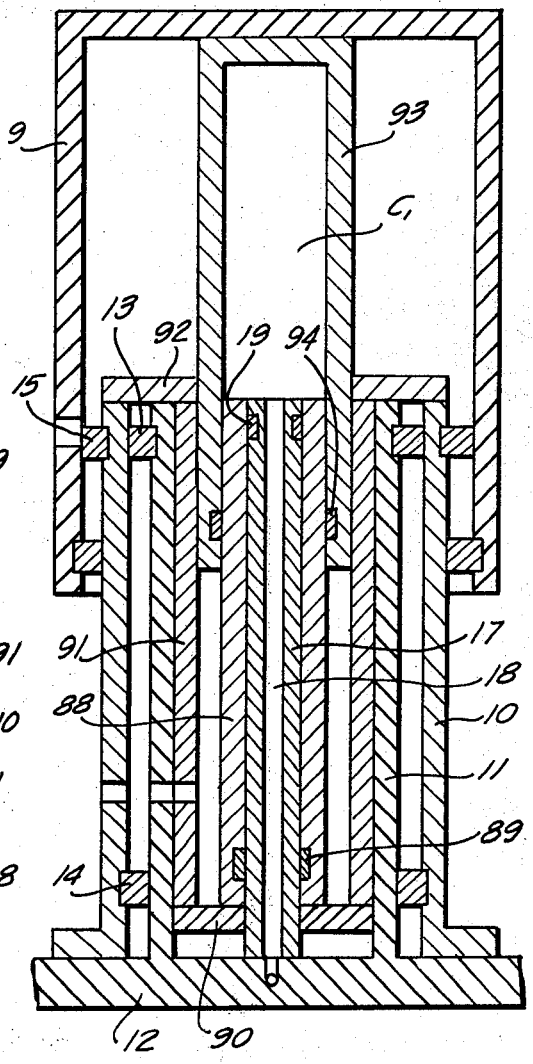
Figure 6:
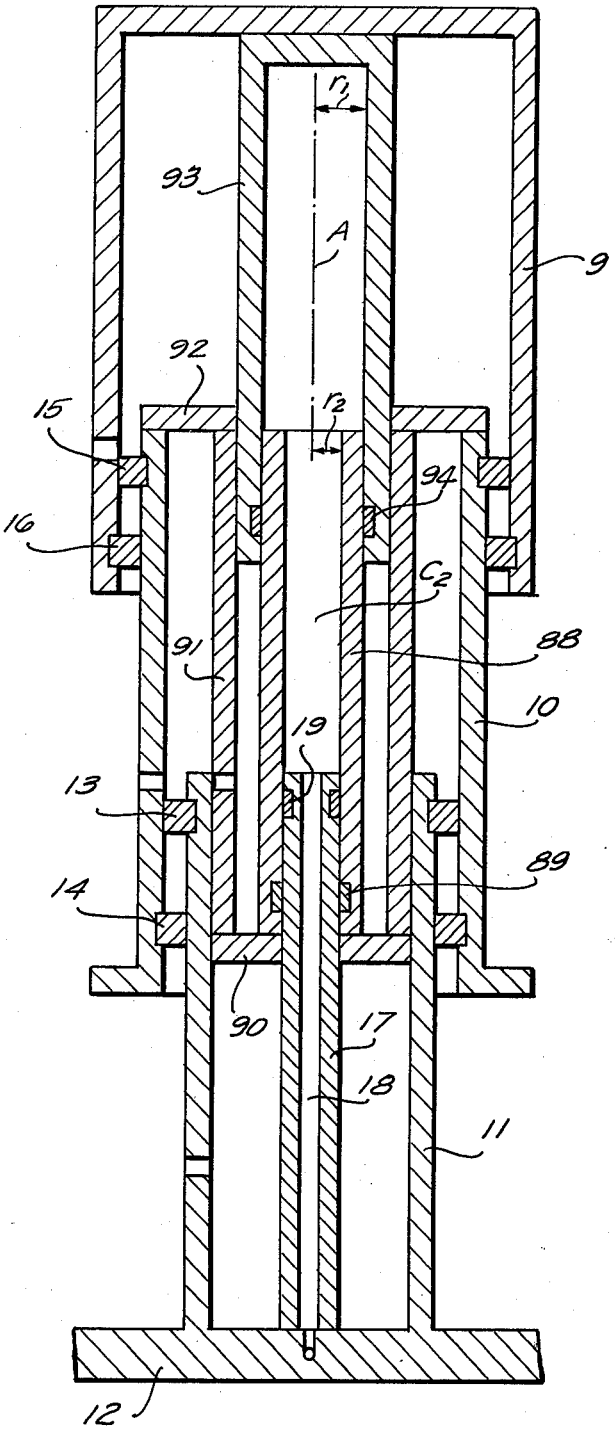

The tubes 9, 10, 11, and 91 are all formed with holes 9′, 10′, 11′, and 91′ respectively. The rings 13–16 are split at one portion in their peripheries so that all of the air spaces between these tubes are open to the atmosphere and pressurization of them is impossible. Thus as fluid is forced by means of the pump 211 (FIG. 10) through the passage 18 into the chamber $C_1$ inside the upper tube 93 this upper tube and the tube 9 carried thereby are forced upwardly as shown in FIG. 5. Once this upper part achieves its maximum upper position the continued pressurization fills the chamber $C_2$ inside the tube 88 so as to extend this tube upwardly. Entrainment of the tube 10 by engagement of ring 15 against the ring 16 of the tube 9 ensures upward movement of this tube 10. The fork 20 will be raised with a speed equal to twice that of the outer tube 9 until this tube 9 is all the way up at which time the fork 20 will not move relative to the tube 9. Thereafter the fork 20 only moves with the tube 9 as the tube 10 rises.

Figure 7:
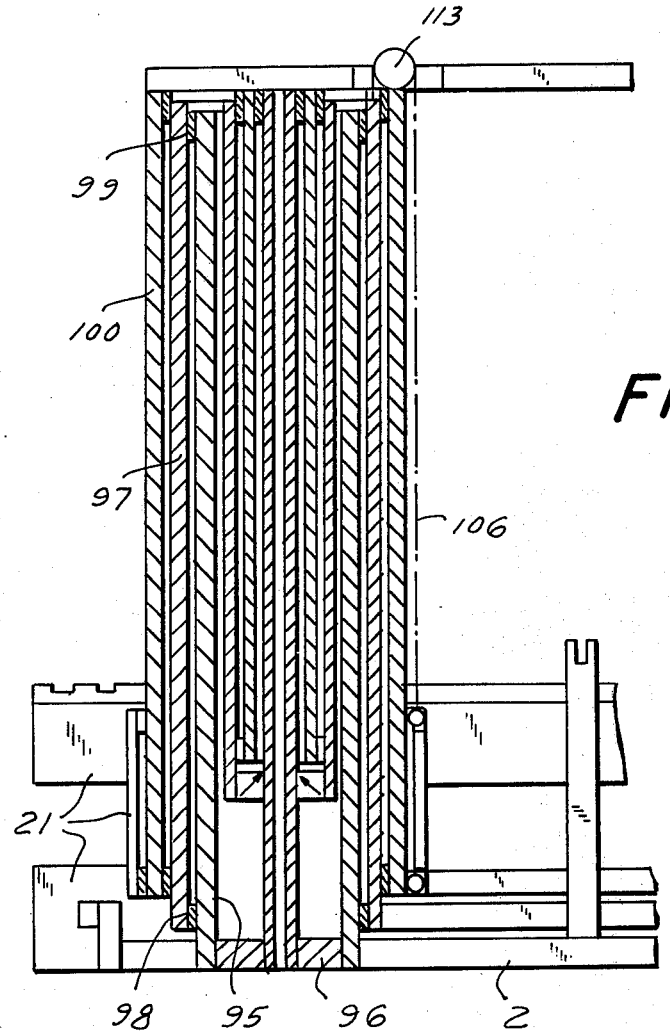
FIG. 7 is a vertical section seen in front view through another arrangement according to this invention, shown in the down position.
Figure 8:
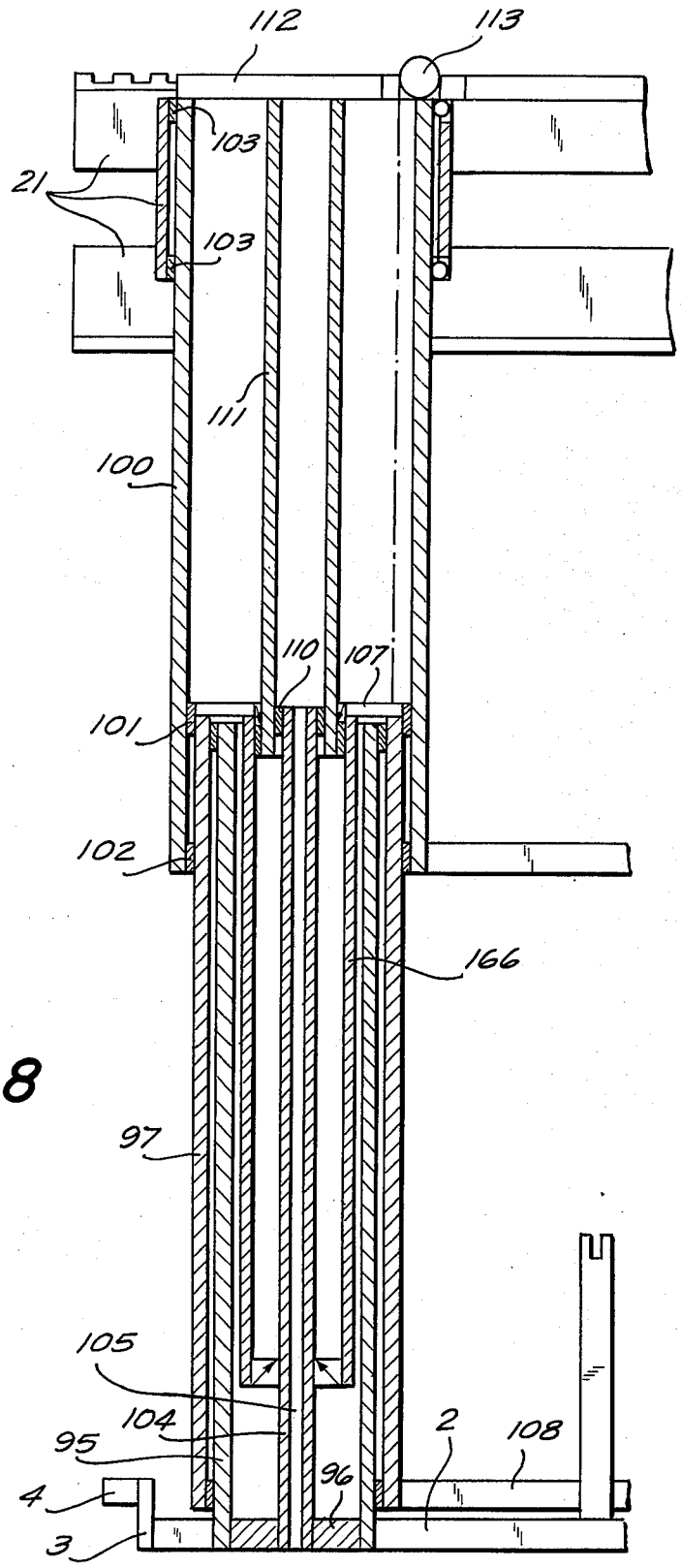
FIGS. 8 and 9 illustrate the assembly of FIG. 7 in the partially raised and fully raised positions, respectively.
Figure 9:
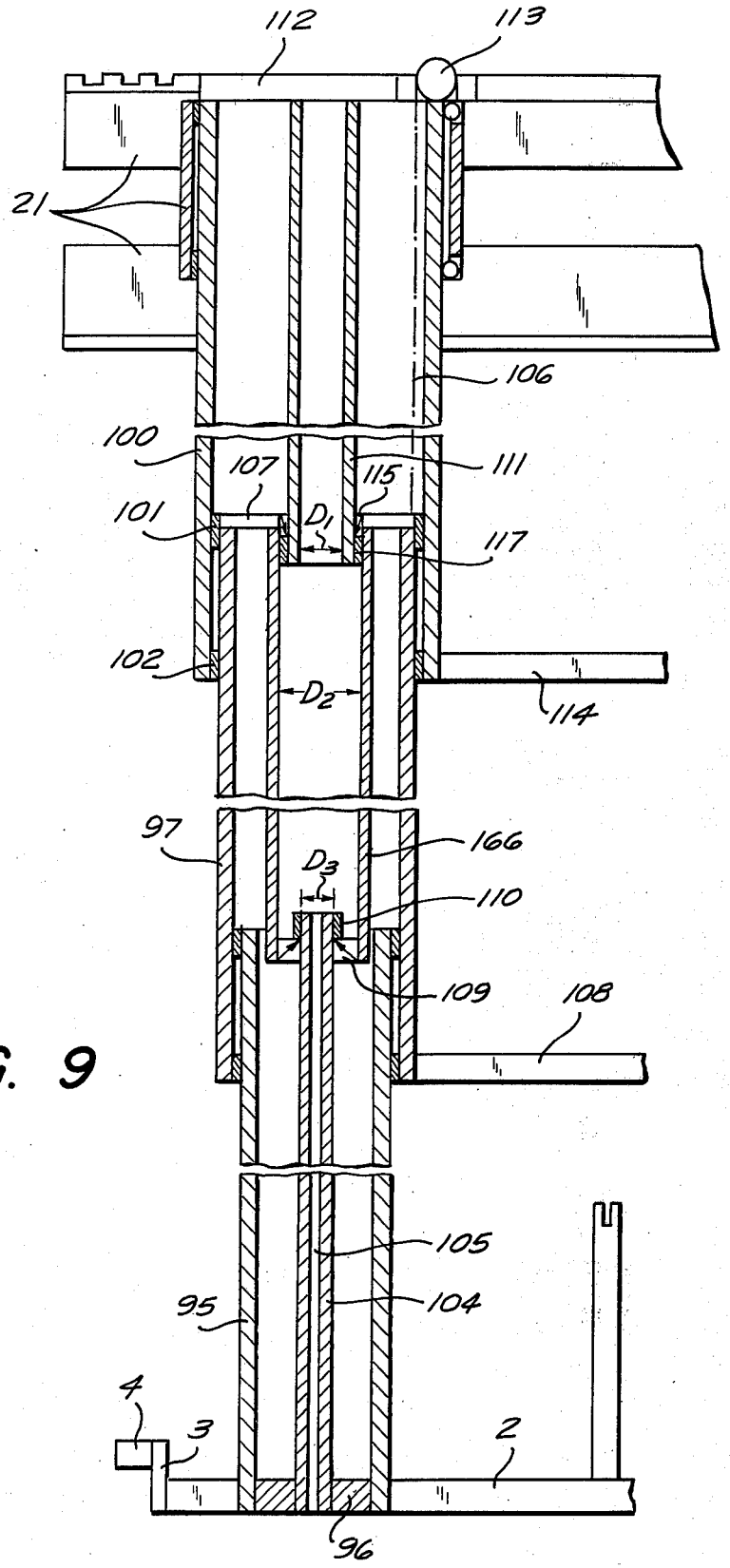

The arrangement shown in FIGS. 7 through 10 has a lower traverse 2 constituting the support and equivalent to the element 204 of FIG. 10. In addition it has a frame 3 and a pivot axis 4 corresponding to the pivot 205 of FIG. 10. The carriage 21 for a fork as shown at 207 in FIG. 10 is also shown in FIGS. 7 through 9. The inner mast tube 95 is secured on the lower traverse beam 2 and is supported on this by means of a reinforcing or stiffening element 96. The intermediate tube 97 is guided on the tube 95 by means of a lower guide 98 on the inner tube 97 and an upper guide 99 on the upper end of tube 95.

An outer tube 100 is slidable on the tube 97, with a guide 101 at the top of the tube 97 and a similar guide 102 at the bottom of the tube 100. The carriage 21 is slidable by means of guide elements 103 on this tube 100.

A piston 104 having a central pressurizing passage 105 is secured on the reinforcement portion 96. A tube cylinder 166 is connected by means of an annular perforated plate 107 to the tube 97 which itself is secured to the intermediate transverse beam 108. The piston 104 is formed as a plunger which is sealed relative to the cylinder 166 by means of a seal 109 and which is provided on its upper end with a guide element 110 which in the completely down position lies on the inner wall of the upper piston element 111. The upper piston element 111 is connected by means of an upper perforated plate 112 with the outer tube 100.

A chain 106 has one end connected to the upper connection plate 107 and another end secured to the carriage 21. This chain 106 is also passed over a roller or sprocket 113 which is carried on the upper plate 112. The two outer tubes 100 are connected together by means of a transverse beam 114. In addition the upper piston is formed as a plunger and sealed by means of a seal 115 relative to the cylinder 116. The upper piston 111 also has on its lower end a guide element 117 which rides on the inside wall of the cylinder 166 and thereby increases the stiffness of the entire ram as it securely carries cylinder 166.

The internal diameter $D_1$ of the upper tube 111 is slightly greater than the outside diameter $D_3$ of the cylinder 104, and substantially smaller than the inside diameter $D_2$ of the tube 166. Thus the effective surface or piston area of the tube 111 is proportional to the diameter $D_2$ and the effective piston area of the tube 104 is proportional to the diameter $D_3$. The effective surface area, however, of the tube 166 is proportional to the difference between the diameters $D_2$ and $D_3$. These diameters are so dimensioned that the force upward on the ram element 111 is greater than the force downward on the element 166 so as to force the upper element 100 up before the middle portion 97.

We claim:

1. A load-lifting assembly comprising:

a support;

an upright inner tube fixed on said support;

an intermediate tube vertically telescopingly slidable on said inner tube and guided thereon;

an outer tube vertically telescopingly slidable on said intermediate tube and guided thereon;

a load-engaging carriage vertically slidable along and guided on said outer tube;

a flexible elongated element connected to said carriage for controlling the displacement thereof;

a three-stage extensible hydraulic ram in addition to said tubes and having a first member secured to said inner tube, a second member riding on said first member and secured to said intermediate tube, and a third member riding on said second member and secured to said outer tube; and means for pressurizing said three-stage ram to telescope said members for displacing said tubes and carriage from a down position with said carriage lowered and said outer tube completely surrounding said intermediate tube and said inner tube, an upper position with said carriage lifted and said tubes telescoped upwardly.

2. The assembly defined in claim 1 wherein said second and third members are second and third tubes receivable one within the other and said first member is a piston receivable within said second and third tubes.

3. The assembly defined in claim 2, further comprising a connecting tube surrounding and guided on said third tube and guided on and within said inner tube, said connecting tube having an upper end secured rigidly to the upper end of said intermediate tube and a lower end secured rigidly to the lower end of said second tube.

4. The assembly defined in claim 3, further comprising an annular plate connecting the upper end of said connecting tube to the upper end of said intermediate tube and another connecting plate connecting the lower end of said connecting tube to the lower end of said second tube, said means for pressurizing including a passage extending through said piston and opening into the space within the second and third tubes.

5. The apparatus defined in claim 4 wherein said flexible element has one end operatively connected to said carriage and another end operatively connected to said intermediate tube, said outer tube being provided with a roller, said element being spanned over said roller.

6. The assembly defined in claim 2 wherein said second tube surrounds and is guided on said piston and said third tube, said piston being receivable within said third tube, said third tube receiving said piston and said second tube receiving said third tube and said piston in said down position.

7. The assembly defined in claim 6, further comprising a roller on said outer tube, said flexible element passing over said roller and having one end extending down between said third tube and said outer tube and operatively connected to the said intermediate tube and another end connected to said carriage outside said outer tube.

8. The assembly defined in claim 7 wherein said piston is provided at its upper end with a seal snugly engaging the inside wall of said third tube, said second tube being provided at its upper end with a plate connected rigidly to the upper end of said intermediate tube.

9. A load-lifting assembly for a fork-lift truck or the like, said assembly comprising:

a support;

an upright innermast tube fixed on said support;

an intermediate mast tube vertically telescopingly slidable on said inner mast tube and guided thereon;

an outer mast tube vertically telescopingly slidable on said intermediate mast tube and guided thereon;

a load-engaging carriage vertically slidable along and guided on said outer mast tube;

a roller operatively mounted on the upper end of said outer mast tube;

a flexible elongated element passing over said roller and having one end connected to said carriage and another end operatively connected to said intermediate mast tube;

a three-stage extensible hydraulic ram in addition to said tubes and having a first tubular member secured to said inner mast tube, a second tubular member riding on said first member and secured to said intermediate mast tube, and a third tubular member riding on said second member and secured to said outer mast tube, said mast tubes and members all being coaxial, the space between said ram on one side and said mast tubes on the other side being open to the atmosphere; and means for pressurizing said ram to telescope said members for displacing said tubes and carriage from a down position wherein said carriage is lowered, said outer mast tube completely surrounds said intermediate mast tube and said inner mast tube, and said members are all telescoped together, and in up position with said carriage lifted, said mast tubes telescoped upwardly, and said members telescoped upwardly.

10. The assembly defined in claim 9 wherein said third member has an effective piston area greater than the effective piston area of said second member.

* * * * *